US007075392B2

(12) United States Patent
Smith et al.

(10) Patent No.: US 7,075,392 B2
(45) Date of Patent: Jul. 11, 2006

(54) MICROWAVE RESONATOR AND FILTER ASSEMBLY

(75) Inventors: David John Smith, Cambridge (CA); Ming Yu, Waterloo (CA)

(73) Assignee: Com Dev Ltd., Cambridge (CA)

( * ) Notice: Subject to any disclaimer, the term of this patent is extended or adjusted under 35 U.S.C. 154(b) by 0 days.

(21) Appl. No.: 10/678,109

(22) Filed: Oct. 6, 2003

(65) Prior Publication Data

US 2005/0073378 A1 Apr. 7, 2005

(51) Int. Cl.
*H01P 7/10* (2006.01)
*H01P 1/201* (2006.01)

(52) U.S. Cl. ..... 333/202; 333/219.1

(58) Field of Classification Search ..... 333/202, 333/203, 206, 207, 212, 230, 222, 219, 219.1
See application file for complete search history.

(56) References Cited

U.S. PATENT DOCUMENTS 3,571,768 A * 3/1971 Gundry ..... 333/230
4,652,843 A 3/1987 Tang et al.
4,963,841 A 10/1990 Sparagna
5,220,300 A 6/1993 Snyder
5,262,742 A * 11/1993 Bentivenga ..... 333/203
5,410,284 A * 4/1995 Jachowski ..... 333/202
5,585,331 A 12/1996 Mansour et al.
5,608,363 A 3/1997 Cameron et al.
5,812,036 A * 9/1998 Estrada ..... 333/202
5,880,650 A 3/1999 Latouche et al.
6,054,909 A 4/2000 Lee et al.
6,239,673 B1 5/2001 Wenzel et al.
6,255,919 B1 7/2001 Smith
6,297,715 B1 10/2001 Fiedziuszko et al.
6,686,815 B1 * 2/2004 Mirshekarl-Syahkal et al. ..... 333/202

FOREIGN PATENT DOCUMENTS

JP 0 213 7501 5/1990

OTHER PUBLICATIONS

Torregrosa-Penalva, G. et al., "A Simple Method to Design Wideband Electronically Tunable Combline Filters", IEEE Transactions on Microwave Theory and Technique, vol. 10, No. Y, 2001. pp. 1-6.

(Continued)

*Primary Examiner*—Seungsook Ham
(74) *Attorney, Agent, or Firm*—Bereskin & Parr; Isis E. Caulder

(57) ABSTRACT

A half wave dielectric resonator assembly including a resonator cavity having a top surface and a bottom surface, an elongated cylindrical dielectric resonator positioned within said resonator cavity and first and second insulative supports to couple and insulate the ends of the cylindrical dielectric resonator from the resonator cavity. The dielectric resonator has a substantially small diameter to length ratio. The resonator assembly provides improved spurious performance and quality factor (Q) at a lower mass. A resonator filter is constructed using a plurality of these resonator assemblies, where adjacent pairs of said resonator cavities are separated from each other by a common cavity wall. By forming a first iris opening formed within a first common cavity wall and forming a second iris opening formed within a second common cavity wall having a position that is vertically offset from the position of the first iris, it is possible to reduce stray coupling.

11 Claims, 11 Drawing Sheets

OTHER PUBLICATIONS

Kafjez, Darko, "Q Factor Measurements, Analog and Digital", University of Mississippi, pp. 1-18. 1999.
Langham, C.D. et al., "Development of a High Stablity Cryogenic Sapphire Dielectric Resonator", IEEE Transactions on Instrumentation and Measurement, IEEE Inc., vol. 42, No. 2, pp. 96-98, Apr. 1, 1993, New york, U.S.A.
Kobayashi, Y. et al., "Resonant Modes in Shielded Unlaxial-Anisotropic Dielectric Rod Resonators", IEEE Transactions on Microwave Theory and Techniques, IEEE Inc., vol. 41, No. 12, pp. 2198-2205, Dec. 1, 1993, New York, U.S.A.
Yu, M. et al., "Half-wave Dielectric Rod Resonator Filter", IEEE, Cambridge, Ontario, Canada., Jun., 2004.
Wang, C. et al., "Dielectric Combline Resonators and Filters", IEEE Transactions on Microwave Theory and Techniques, IEEE Inc., vol. 48, No. 12, pp. 2501 to 2508, Dec., 1998.

* cited by examiner

MICROWAVE RESONATOR AND FILTER ASSEMBLY

FIELD OF THE INVENTION

This invention relates to microwave communication equipment and more particularly to microwave resonator and resonator filter assemblies.

BACKGROUND OF THE INVENTION

Conventional resonator structures currently being used in microwave filters suffer from various practical and operational limitations including small tuning range, inadequate spurious performance, high complexity and excessive mass. These characteristics are not optimum for use in the field of space communication applications such as satellite communications where mass, volume and electrical performance are of critical importance. The most commonly used prior art resonator structures for microwave filters are shown in FIGS. 1A, 1B and 1C as discussed below. The relative electric field strength is indicated by in the graphs by shading type.

FIG. 1A illustrates the electrical field pattern of a conventional $TE_{01\delta}$ mode (puck) resonator 2 that is supported by a platform support 1. Resonator 2 is made from a material with a high dielectric constant (e.g. generally between 20 and 40). Resonator support 1 has a smaller diameter and is made from a material with a low dielectric constant (e.g. generally between 3 and 5). This kind of resonator and support assembly is disclosed in U.S. Pat. No. 5,608,363 to Cameron et al. FIG. 1A shows the electric field strength in the YZ plane for puck resonator 2 located within a metallic cavity 3. As shown, the maximum electric field intensity generated, resides within the resonator 2. The electric field pattern is symmetrical about the Z-axis in a donut shaped pattern, as shown. Puck resonator 2 is used where a quality factor (Q) greater than 8000 is required in the 3.4 to 4.2 GHz communication band, as is the case for space applications. However, the nearest spurious mode for puck resonator 2 operating at 3.42 GHz is too close to the top of the communication band (4.2 GHz). When puck resonators 2 are combined to produce a filter, these spurious modes move even closer to the filter pass-band due to the cumulative effects of irises, probes and tuning screws causing interference with filters centered between 4.0 and 4.2 GHz. Another important disadvantage of puck resonator 2 is that since the electrical field is spread out (as shown in FIG. 1A), tuning screws do not effectively interrupt the electrical field resulting in a small tuning range. Further, when multiple resonators are combined to form a filter, undesired (stray) couplings are generated between non-adjacent resonators and require additional diagonal probes for cancellation purposes. These diagonal probes result in added complexity, increased mass and performance degradation for the resonator and filter assembly.

FIG. 1B illustrates the electrical field pattern of another conventional type of resonator 5, namely the metal combline (TEM mode) resonator 5. Combline resonator 5 is housed within and is in electrical contact at one end with a metallic cavity 6. Typically, the resonator 5 and metallic cavity 6 are fastened together using mechanical means (i.e. a screw). This structure is commonly used within ground station filters where quality factor (Q) is traded off for reduced mass, size and complexity. Combline resonator 5 exhibits the best spurious performance where the nearest spurious mode is generally greater than two times the fundamental frequency.

The size is approximately half of the size of the puck resonator but the resulting quality factor (Q) is generally about half of the Q of the puck resonator. This lower Q makes the metal combline unusable for satellite multiplexer filters. The electric field strength is minimum at the bottom of the resonator and maximum at the top giving a one quarter wave variation over the length of the resonator. A tuning screw (not shown) is placed at the top of metallic cavity 6 where the electric field is strongest, resulting in a large tuning range. The electric field pattern is symmetrical about the Z-axis with no electric field inside the metal resonator. The complexity of the metal combline resonator 5 is less than that of the puck resonator 2 (FIG. 1A) since a supporting platform is not required.

FIG. 1C illustrates the electrical field pattern of a quarter wave dielectric (QWD) resonator 8 operating in the TM01 mode. As shown, QWD resonator 8 is housed within and is in electrical contact at one end with a metallic cavity 9. Typically, QWD resonator 8 and metallic cavity 9 are fastened together using adhesive and/or mechanical means. While, quarter wave dielectric resonator 8 has an improved (i.e. higher) quality factor (Q) in respect of the metal combline resonator 5, QWD resonator 8 still cannot meet the required Q>8000 criteria. This is primarily due to the fact that the quality factor (Q) of QWD resonator 8 is limited due to losses caused by the resonator 8 and cavity 9 being in electrical contact. The electric field strength is minimum at the bottom of the resonator and maximum at the top giving a one quarter wave variation over the length of the resonator. The tuning screw is placed at the top where the electric field is strongest resulting in a large tuning range. The electric field pattern is symmetrical about the Z-axis with some electric field inside the resonator. Due to the electrical and magnetic characteristics associated with QWD resonator 8, a high intensity magnetic field will be produced at one end resulting in high current density in the walls of cavity 9 reducing the quality factor (Q). Again, the QWD resonator 8 is less complex than puck resonator 2 since the supporting platform is not required.

SUMMARY OF THE INVENTION

The invention provides in one aspect, a resonator assembly for operation at a desired frequency, said resonator assembly comprising:

(a) a resonator cavity having a top surface and a bottom surface;

(b) an elongated cylindrical dielectric resonator with a substantially small diameter to length ratio, said elongated cylindrical dielectric resonator being positioned within said resonator cavity;

(c) first and second insulative supports coupled between the ends of the cylindrical dielectric resonator and the top and bottom surfaces of the resonator cavity; and (d) such that when an electric field is applied to the resonator assembly, the half wave variation of the electric field resonates at the desired frequency.

In another aspect, the invention provides a resonator filter for filtering an electromagnetic wave, said resonator filter comprising:

(a) a plurality of resonator assemblies coupled to each other, each resonator assembly having a resonator cavity, adjacent pairs of said resonator cavities being separated from each other by a common cavity wall such that there are a plurality of common cavity walls between adjacent resonator cavities and such that each cavity wall has top and bottom edges;

(b) a first iris opening formed within a common cavity wall; and (c) a second iris opening formed within a common cavity wall and having a position that is vertically offset from the position of the first iris opening.

Further aspects and advantages of the invention will appear from the following description taken together with the accompanying drawings.

DETAILED DESCRIPTION OF THE INVENTION

Figure 2A:
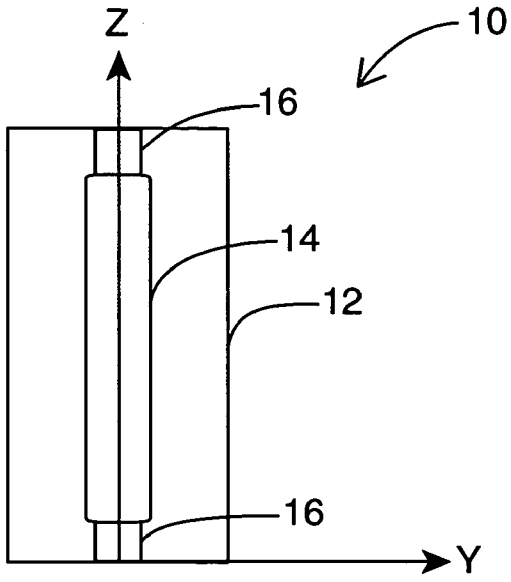
FIG. 2A is a side view of a half wave dielectric resonator assembly built in accordance with the present invention.
Figure 2B:
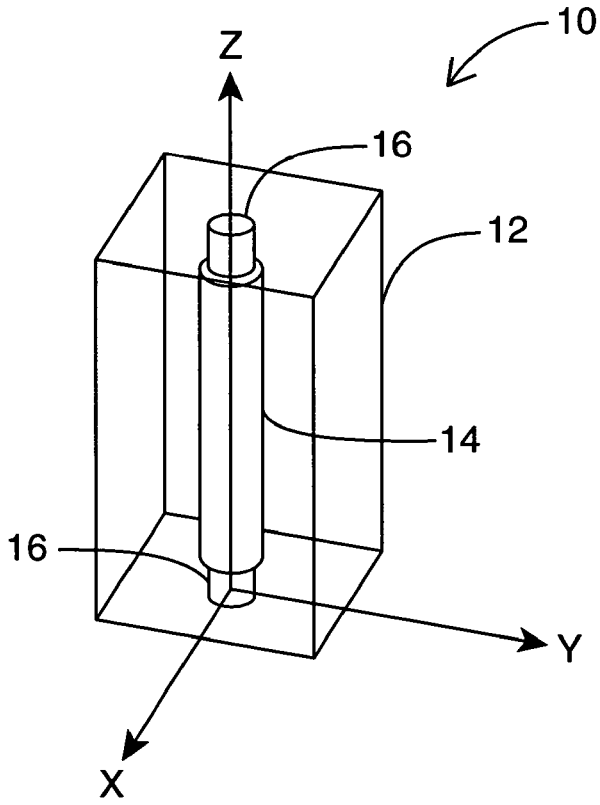
FIG. 2B is a top perspective view of the resonator assembly of FIG. 2A.

FIGS. 2A and 2B illustrate a preferred embodiment of a half wave resonator assembly 10, built in accordance with the present invention. Resonator assembly 10 operates in the TM mode, exhibits a high quality factor (Q) value and good spurious performance as will be described. Further, when a number of resonator assemblies 10 are combined into a resonator filter as will be discussed, it is possible to cancel out stray couplings without the need to use diagonal probes as will be described. Resonator assembly 10 consists of a resonator cavity 12, a cylindrical dielectric resonator 14 and end supports 16 where the dielectric resonator 14 and end supports 16 are mounted within the metallic cavity 12.

Figure 1A:
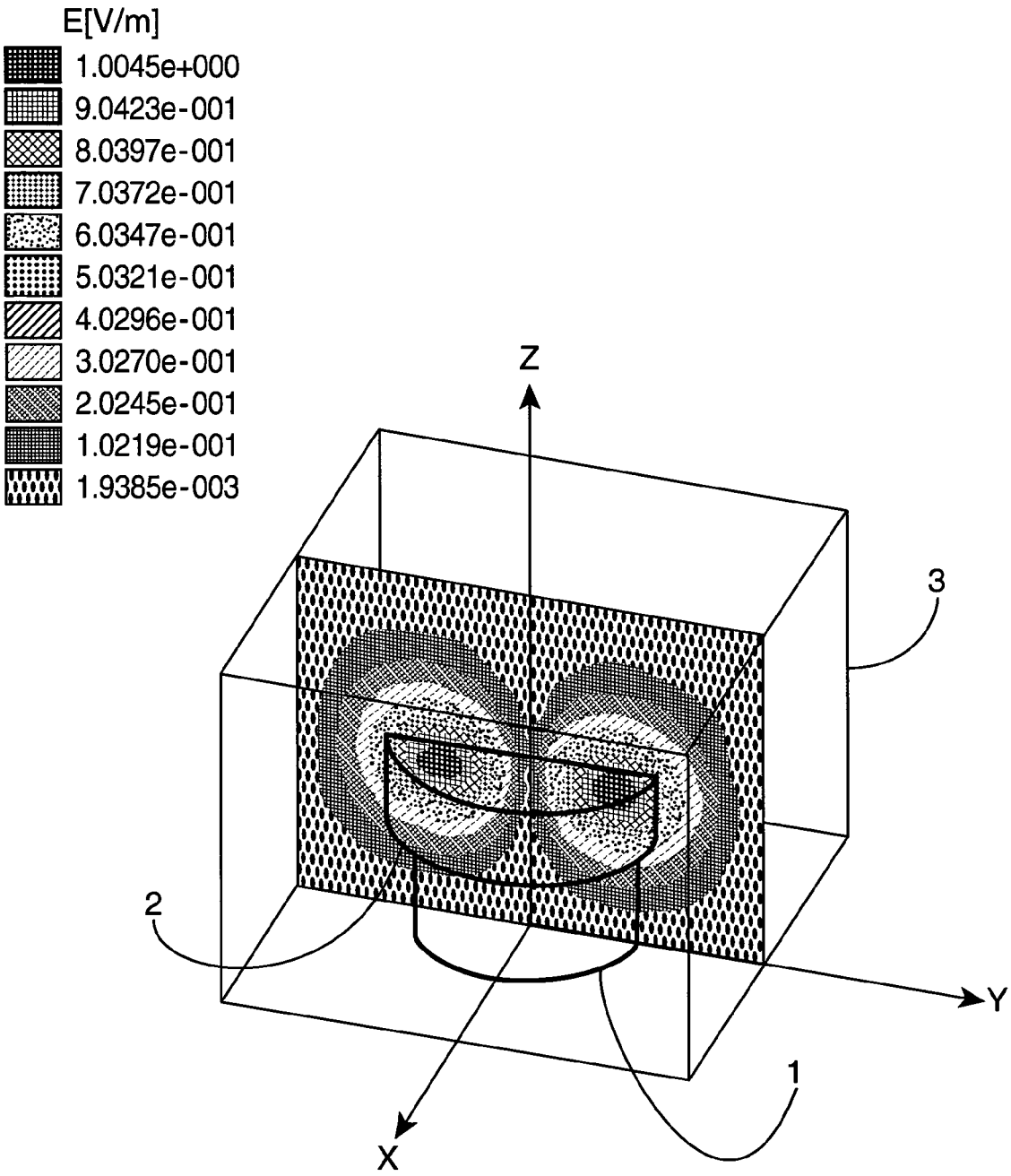
FIG. 1A PRIOR ART
FIG. 1A is a top perspective view of a conventional prior art $TE_{01\delta}$ mode (puck) resonator assembly and the resonator's associated electric field strength characteristics.

Resonator cavity 12 is a conventional resonator cavity preferably constructed of silver-plated aluminum, although many other types of materials could be used (e.g. copper, brass, etc.) As shown, resonator cavity 12 has a larger cavity height than that associated with conventional $TE_{01\delta}$ mode (puck) resonator 2 (FIG. 1A). However, this increased height is acceptable within the spatial parameters onboard a spacecraft.

Dielectric resonator 14 is an elongated cylindrical dielectric body having a substantially small diameter to length ratio as shown. In the 3.4 to 4.2 GHz range the preferred length to diameter ratio varies within the range of 4.5 to 6.0, although it should be understood that length to diameter ratios outside this range can also be used (e.g. 0.21 to 0.17). The specific dimensions of dielectric resonator 14 (e.g. length and diameter of the cylindrical dielectric body) are selected so that a half wave variation of the electric field can resonate at the desired frequency. Also, since the electrical field is more concentrated at the top and the bottom of dielectric resonator 14, tuning screws (not shown) positioned at the top and/or bottom of resonator cavity 12 provide a reasonably large tuning range.

End supports 16 are used to mount dielectric resonator 14 to the top and bottom walls of resonator cavity 12 at each end of dielectric resonator 14. Specifically, end supports 16 are coupled in between ends of dielectric resonator 14 and the top and bottom walls of resonator cavity 12. By separating dielectric resonator 14 from the walls of resonator cavity 12, the quality factor (Q) can be improved. While end supports 16 are preferably constructed out of quartz, it should be understood that any low loss insulative material (e.g. corderite, alumina, etc.) could be utilized. In addition, it is desirable to construct end supports 16 out of a material, such as quartz, which has a low coefficient of thermal expansion (CTE) so that performance is not affected at variable temperature. The CTE of the material used for the dielectric resonator 14 is chosen so that it compensates for the CTE of end supports 16 and for the CTE of the resonator cavity 12, whereby the resonant frequency of the resonator assembly 10 or a filter constructed from a plurality of resonator assemblies 10 will remain constant when the temperature changes.

Since dielectric resonator 14 is a half wave resonator, the electrical field is maximum at the ends of dielectric resonator 14 and minimum in the middle. Accordingly, the current density at the ends of the resonator is minimum and end supports 16 are positioned at low current density points within resonator assembly 10. Accordingly, a relatively low current density is present along the walls of resonator cavity 12 that results in a higher quality factor (Q) for the overall resonator assembly 10. As is conventionally known, when an electric field is provided to resonator cavity 12 the half wave variation of the electrical field will resonate within resonator cavity 12 and the cylindrical dielectric resonator 14 at a particular frequency. The length of resonator assembly 10 may be adjusted to achieve the desired resonant frequency.

Figure 2C:
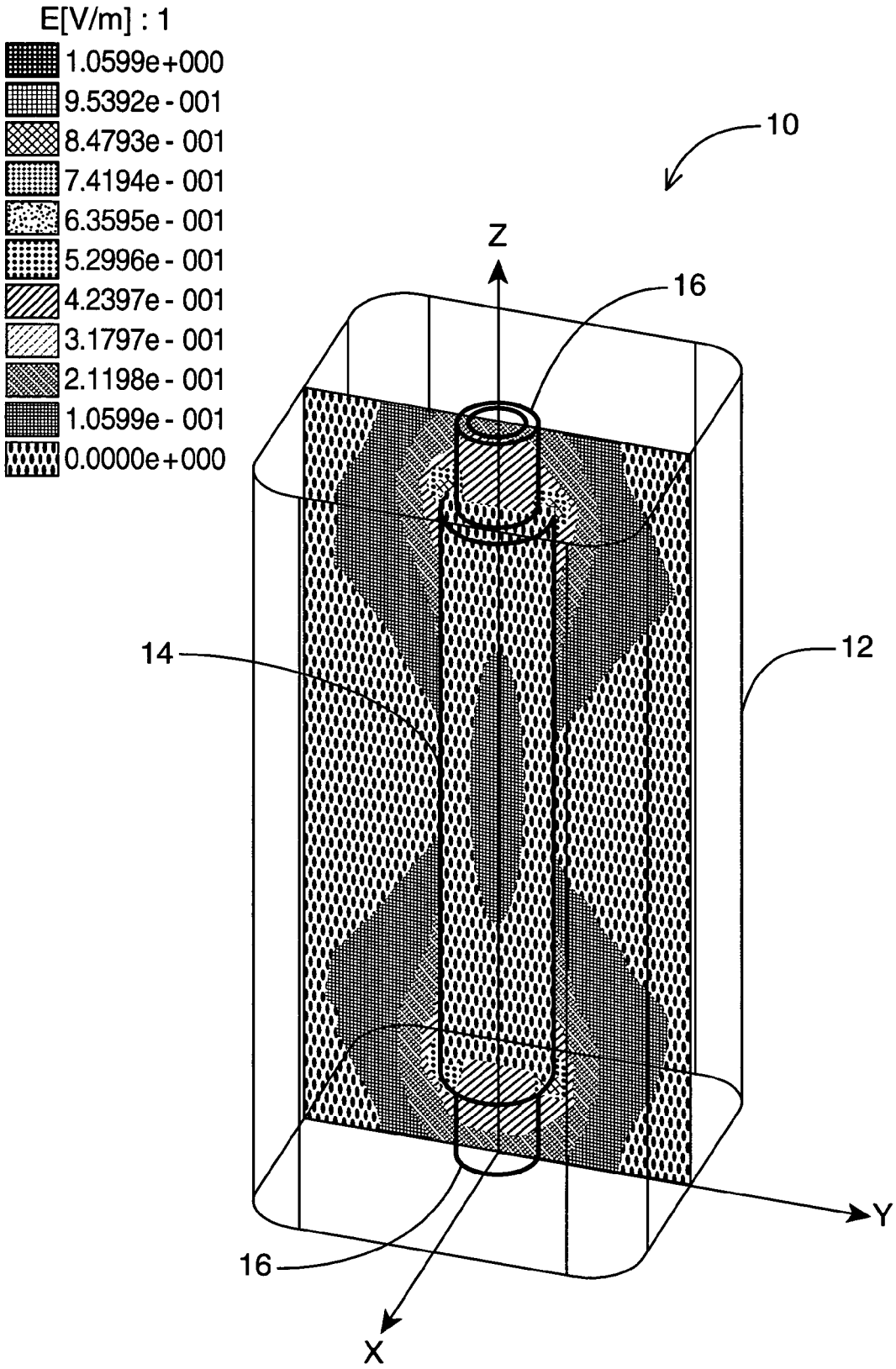
FIG. 2C is a top perspective view of the resonator assembly of FIGS. 2A and 2B and the resonator's associated electric field strength.

FIG. 2C illustrates the electrical field pattern for half wave resonator assembly 10. Specifically, the electric field strength is minimum in the middle of the dielectric resonator 14 and maximum at the top and bottom of dielectric resonator 14 giving a one half wave variation over the length of dielectric resonator 14. A tuning screw (not shown) is placed at the top of resonator assembly 10 where the electric field is strongest resulting in a large tuning range. As shown, the electric field pattern is symmetrical about the Z-axis with some electric field present within the resonator.

Prior Art Comparison

Figure 1B:
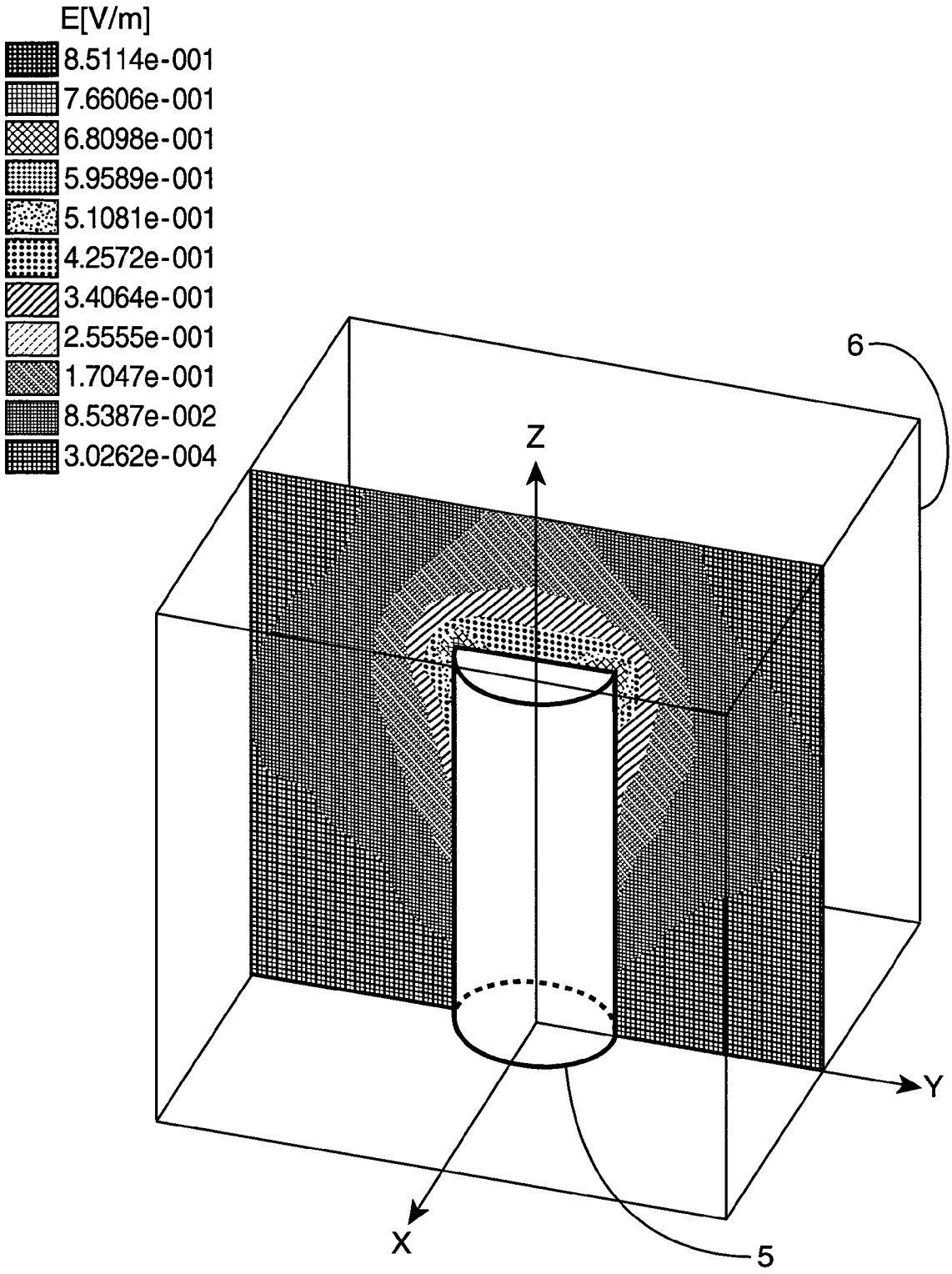
FIG. 1B PRIOR ART
FIG. 1B is a top perspective view of a conventional prior art metal combline (TEM mode) resonator assembly and the resonator's associated electric field strength characteristics.
Figure 1C:
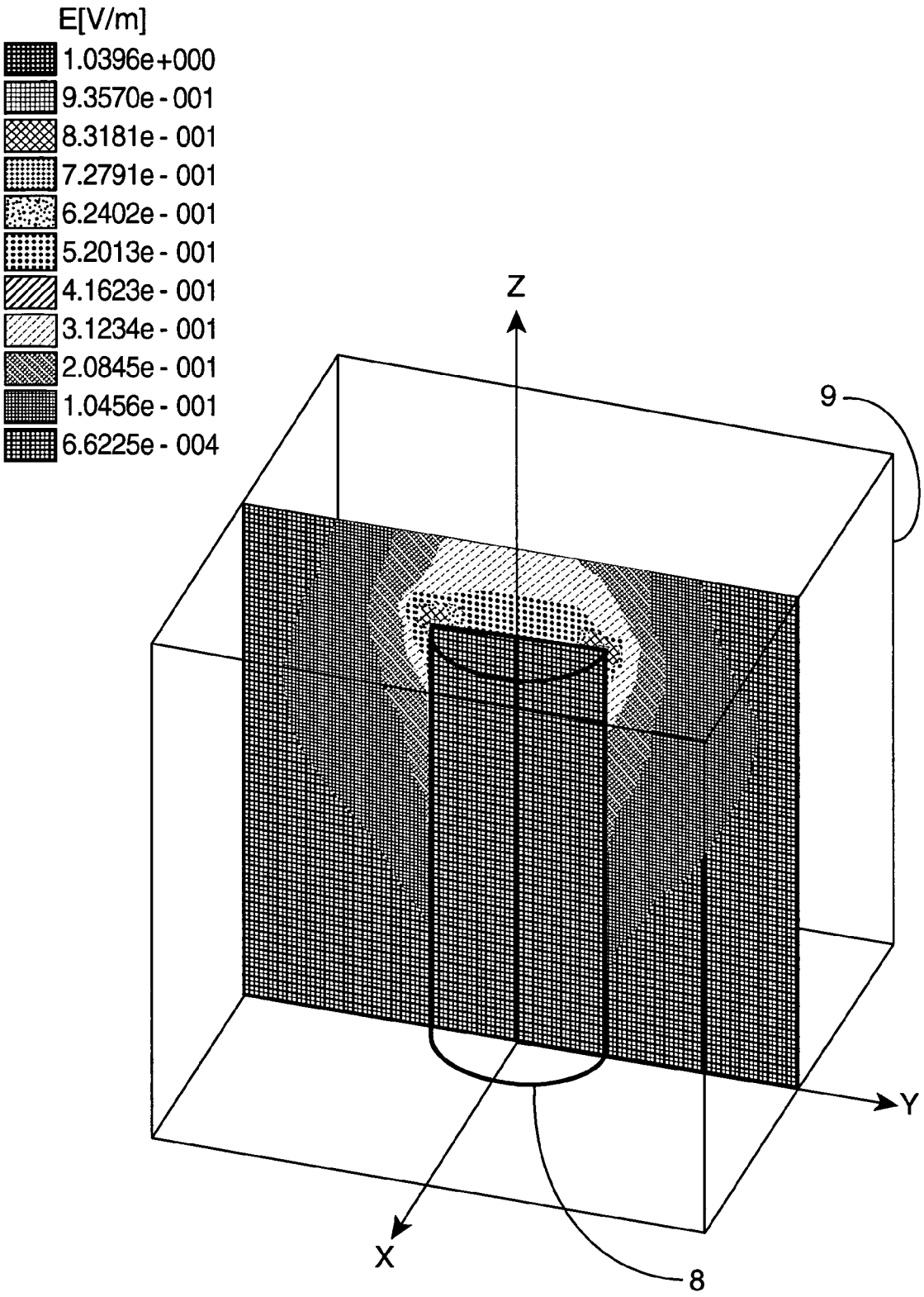
FIG. 1C PRIOR ART
FIG. 1C is a top perspective view of a conventional prior art quarter wave dielectric (QWD) resonator assembly and the resonator's associated electric field strength characteristics.

Resonator assembly 10 will now be compared with the conventional $TE_{01\delta}$ mode (puck) resonator 2 (FIG. 1A), the metal combline (TEM mode) resonator 5 (FIG. 1B), and the quarter wave dielectric (QWD) resonator 8 (FIG. 1C) on the basis of electrical characteristics, dimensions and mass.

Table 1 provides the values for the key electrical characteristics (Q and the nearest spurious mode in GHz) of each of these resonators in operation at 4 GHz. It should be kept in mind that the resonator assembly with the highest Q and the highest spurious mode frequency is most desirable. As shown, the metal combline TEM resonator 5 (FIG. 1B) and the QWD resonator 8 (FIG. 1C) have a high spurious mode frequency but the quality factor (Q) is unacceptable. As indicated, resonator assembly 10 exhibits a higher frequency for the nearest spurious mode over the $TE_{01\delta}$ mode resonator 2 while exhibiting a superior quality factor (Q) over all three prior art resonators 2, 5 and 8. It should be noted that the quality factor (Q) of the resonator assembly 10 is substantially greater than the required value of 8000. While the nearest spurious mode of the $TE_{01\delta}$ mode resonator 2 can be increased by increasing the diameter to thickness ratio of the puck structure, doing so will increase the mass which is unacceptable for space communication applications as previously discussed.

TABLE 1

Electrical Comparison

| | $TE_{01\delta}$ mod resonator 2 | TEM mod resonator 5 | QWD resonator 8 | resonator assembly 10 |
|---|---|---|---|---|
| Quality factor (Q) | 9,248 | 3,583 | 4,922 | 10,543 |
| nearest spurious mode (GHz) | 4.995 | 9.662 | 5.359 | 5.934 |

Table 2 provides the physical dimensions of each of the prior art resonators and resonator assembly 10 in operation at 4 GHz. As shown, neither the metal combline TEM resonator 5 (FIG. 1B) and the QWD resonator 8 (FIG. 1C) have a end support. Noteable, the diameter of resonator assembly 10 is substantially smaller than the diameter of $TE_{01\delta}$ mode resonator 2 and the height of resonator assembly 10 is substantially longer than that of the $TE_{01\delta}$ mode resonator 2. Also, it should be noted that end supports 16 are dimensionally smaller (i.e. have a much smaller diameter) than the platform support used to elevate $TE_{01\delta}$ mode resonator 2 above cavity wall.

TABLE 2

Dimension Comparison

| | $TE_{01\delta}$ mode resonator 2 | TEM mode resonator 5 | QWD resonator 8 | resonator assembly 10 |
|---|---|---|---|---|
| resonator dim (in) | 0.600 dia × 0.168 h | 0.220/0.160 od/id × 0.575 h | 0.250 dia × 0.660 h | 0.220 dia × 1.34 h |
| support dim (in) | 0.472/0.200 od/id × 0.275 h | none | none | 0.15/0.1 od/id × 0.18 |
| cavity dim (in) | 1.0 × 1.0 × 0.8 h | 0.8 × 0.8 × 0.8 h | 0.8 × 0.8 × 0.8 h | 0.8 × 0.8 × 1.70 h |
| cavity volume ($in^2$) | 0.8 | 0.51 | 0.51 | 1.088 |

Table 3 provides the component and total assembly mass for each of the prior art resonators and resonator assembly 10 in operation at 4 GHz in grams. As shown, the metal combline TEM resonator 5 (FIG. 1B) and the QWD resonator 8 (FIG. 1C) do not have any mass associated with a support element. It should be noted that while the cavity mass of resonator assembly 10 is substantially larger than that of the $TE_{01\delta}$ mode resonator 2, the overall total mass for the resonator assembly 10 is still less than the prior art $TE_{01\delta}$ mode resonator 2. The cavity wall thickness used was 0.030 inches.

TABLE 3

Mass Comparison

| | $TE_{01\delta}$ mode resonator 2 | TEM mode resonator 5 | QWD resonator 8 | resonator assembly 10 |
|---|---|---|---|---|
| resonator mass (g) | $3.89^{(3)}$ | $0.74^{(4)}$ | $2.65^{(3)}$ | $4.17^{(3)}$ |

TABLE 3-continued

| | Mass Comparison | | | |
|---|---|---|---|---|
| | $TE_{01\delta}$ mode resonator 2 | TEM mode resonator 5 | QWD resonator 8 | resonator assembly 10 |
| support mass (g) | 1.7(2) | 0 | 0 | 0.14(5) |
| cavity mass (g) | 3.52(1) | 2.63(1) | 2.63(1) | 4.7(1) |
| Total | 9.11 | 3.37 | 5.28 | 9.01 |

NOTES:
(1)aluminum = 2.7 gms/cm$^3$
(2)corderite = 2.45 gms/cm$^3$
(3)dielectric = 5.0 gms/cm$^3$
(4)titanium = 4.5 gms/cm$^3$
(5)quartz = 2.45 gms/cm$^3$ Accordingly, when compared to the $TE_{01\delta}$ mode resonator 2 described in U.S. Pat. No. 5,608,363, resonator assembly 10 provides substantially improved spurious performance (19%) and quality factor (Q) (14%) and this can be achieved at a lower mass (−1%).

FIGS. 3A, 3B, 3C and 3D illustrate the physical layout of a resonator filter 20 that utilizes a series of resonator assemblies 10 (designated as r1, r2, to r10), as discussed above. While the resonator filter 20 illustrated in FIGS. 3A, 3B, 3C and 3D is constructed from ten half wave resonator assemblies 10 (as designated by "r1" to "r10" in FIG. 3A), it should be understood that any number of half wave resonator assemblies 10 could be utilized to form resonator filter 20. Resonator filter 20 also includes coaxial input probe 22, output probe 23 and cross probes 24 as is conventionally known. Specifically, an electromagnetic wave is provided to resonator filter 20 through input probe 22, transmitted through each of the resonator assemblies 10 and then the filtered electromagnetic wave is provided by resonator filter 20 at output probe 23. The configuration and structure of the cavities and resonators within resonator assemblies 10 affect the frequency response of resonator filter 10. Input probe 22 and output probe 23 are preferably simple discs and cross probes 24 are straight wires, although various physical configurations could be used.

Figure 3B:
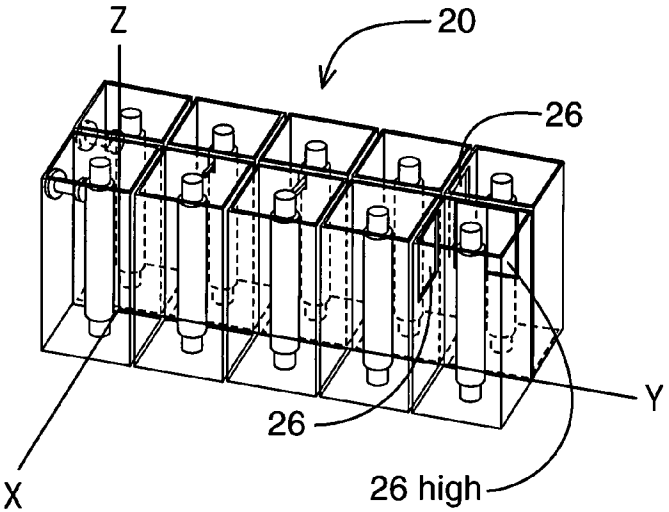
FIG. 3B is a top perspective view of the resonator filter of FIG. 3A.
Figure 3A:
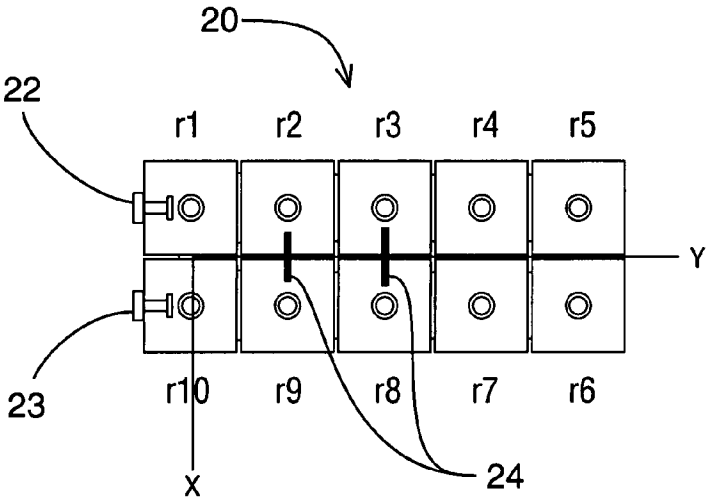
FIG. 3A is a top view of a resonator filter constructed using ten of the resonator assemblies of FIG. 2A.
Figure 3D:
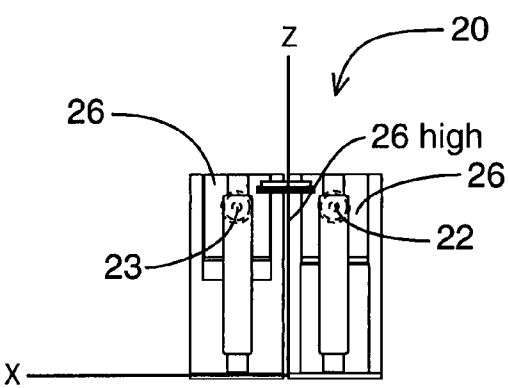
FIG. 3D is a side view of the resonator filter of FIG. 3A in the X-Z plane.
Figure 3C:
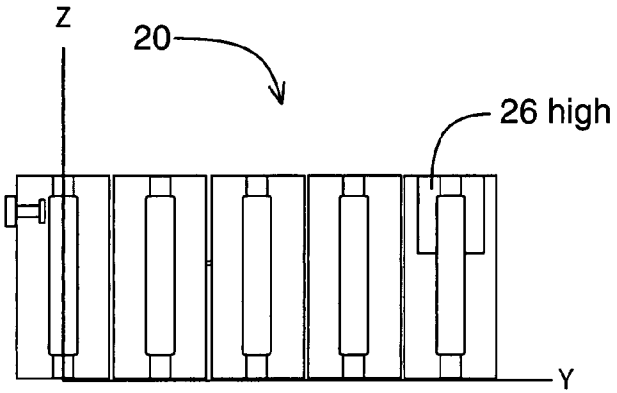
FIG. 3C is a side view of the resonator filter of FIG. 3A in the Y-Z plane.

Also, as is conventionally known, a plurality of iris openings 26 (as shown in FIGS. 3B, 3C and 3D) are provided within the cavity walls of resonator filter 20. The iris openings 26 are consistently positioned at the upper end of cavity walls (i.e. near the top surface of the resonator filter 20) above the imaginary horizontal "center line" of the cavity wall. As is conventional, iris openings 26 are rectangular-shaped as shown in FIGS. 3B, 3C and 3D. The input electromagnetic wave provided to resonator filter 20 is passed between adjoining resonating cavities through iris openings 26. For example, the signal is coupled from resonating assembly r5 to the adjoining resonating assembly r6 by the iris opening 26high (FIGS. 3B and 3C). As shown, iris opening 26high is a rectangular iris opening cut from just below the top wall of resonator filter 20. As conventionally, known an iris opening 26 within the cavity wall between resonating assemblies r5 and r6 can be used to achieve a wide range of inter-stage coupling coefficients at the dielectric resonator's resonant frequency while also achieving a large reduction in the coupling coefficient of frequencies different from the desired frequency. As the signal passes from resonating assembly r5 to the adjoining resonating assembly r6, a susceptive discontinuity is generated from reflections at the junction. As conventionally known, the specific dimensions of the iris opening 26high can be chosen and a tunable capacitor embedded to adjust the effects of iris opening 26high.

Each of the ten individual resonator cavities of each resonator assembly r1 to r10 resonates at a different resonance center frequency. Accordingly, resonator filter 20 is a conventional ten-pole comb filter. In addition, some coupling feedback is provided within resonator filter 20 between resonator assemblies r2 and r9 and between resonator assemblies r3 and r8 (as shown in FIG. 3A) using cross probes 24. This coupling feedback affects (i.e. steepens) the filter characteristics to compensate for increased rejection near stop band edges. Probes 24 are straight instead of the conventional curved ones used in association with the $TE_{01\delta}$mode resonator 2. This is due to the fact that in resonator filter 20, the electrical field generated by each dielectric resonator 14 radiates transverse to the wall of the cavity 12 in contrast to the electrical fields generated by $TE_{01\delta}$mode resonators 2 which are not transverse to the walls of the cavities 3. This provides a manufacturing and weight advantage since probes 24 do not need to be bent and since (slightly) lighter probes 24 are used within resonator filter 20.

As conventionally known, when a plurality of resonator assemblies are cascaded to form a resonator filter, undesired or stray couplings are generated. These stray couplings are generated because adjacent resonators are not perfectly isolated from one another and as a result a certain amount of energy leaks through. These stray couplings cause degradation in performance and must be cancelled out in order for the resonator filter to meet the stringent specifications that are required in high performance ground station and satellite systems. If the stray couplings are not cancelled out, the resonator filter will have an asymmetrical response similar to the response shown in FIG. 4A.

Figure 4A:
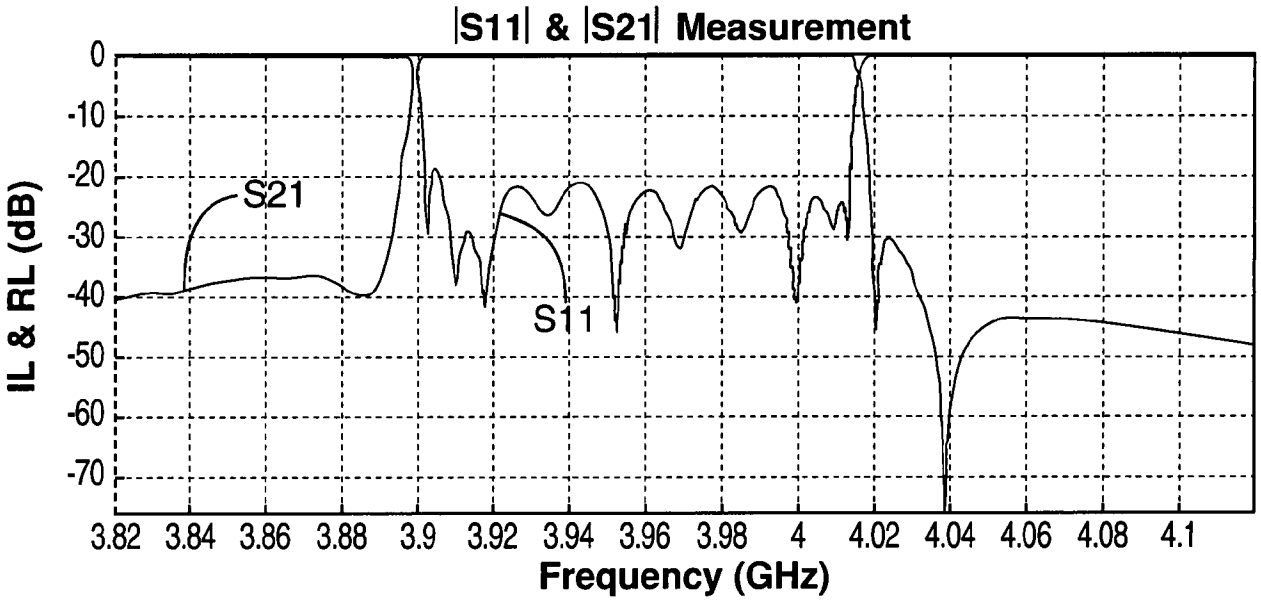
FIGS. 4A and 4B are graphical representations of the RF performance of the resonator filter of FIG. 3A.
Figure 4B:
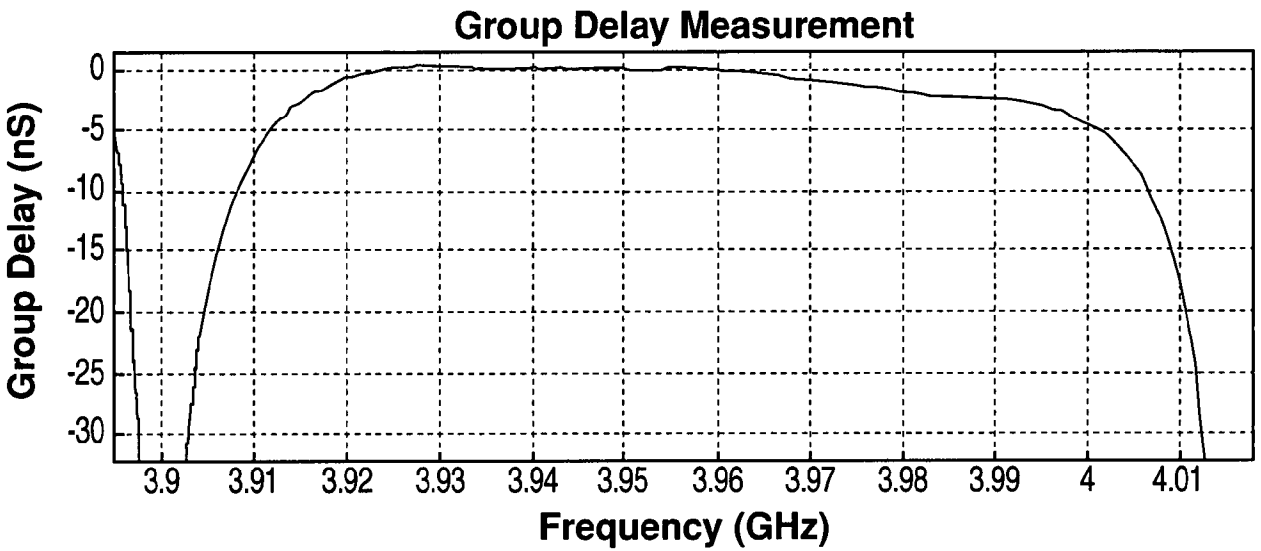

FIGS. 4A and 4B are graphs that illustrate the RF performance of the resonator filter 20 at room temperature. As shown in FIGS. 4A and 4B, the stray couplings generated by adjacent resonators within filter 20 are still present and have not been cancelled out. Specifically, the non-symmetrical insertion loss measurements (i.e. S21 in FIG. 4A) and the group delay measurements (FIG. 4B) indicate that resonator filter 20 has an asymmetrical response and that it would not meet typical performance specifications. As the required bandwidth of resonator filter 20 increases, iris openings 26 must be increased in size causing the stray couplings to become disproportionately larger and to have a more noticeable effect on the filter response. Correcting the response becomes much more difficult. The associated performance degradation is particularly noticeable with bandwidths greater than 50 MHz filters where large iris openings 26 provide less isolation between the non-adjacent cavities.

FIGS. 5A, 5B, 5C and 5D illustrate the physical layout of an example of a resonator filter 30 built in accordance with the present invention. Like resonator filter 20, resonator filter 30 is constructed from a plurality of half wave resonator assemblies 10 (i.e. again designated as "r1", "r2", to "r10" in FIG. 5A). While the resonator filter 20 illustrated in FIGS. 5A, 5B, 5C and 5D is constructed from ten half wave resonator assemblies 10, it should be understood that any number of half wave resonator assemblies 10 could be utilized depending on the amount of stopband attenuation required. Resonator filter 30 also includes coaxial input probe 32, output probe 33, and cross probes 34. Again, while it is preferred to use input probe 32 and output probe 33 that are simple discs and cross probes 34 that are straight wires, various other configurations could be utilized.

Figure 5A:
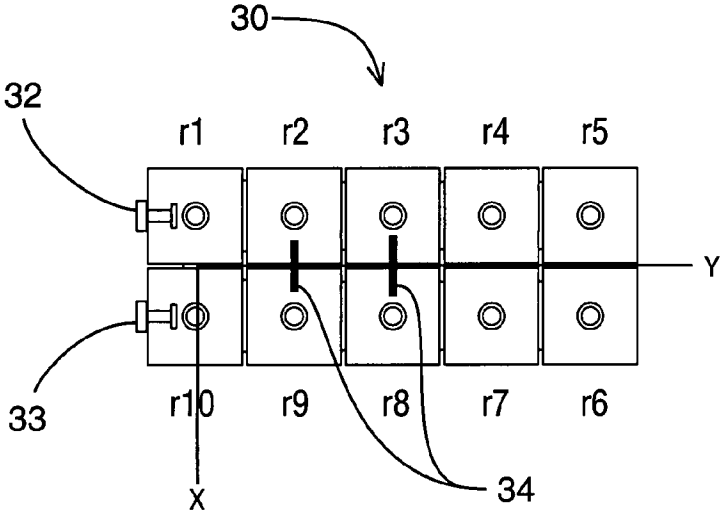
FIG. 5A is a top view of a resonator filter constructed using ten of the resonator assembly of FIG. 2A with vertically low iris opening placement.
Figure 5B:
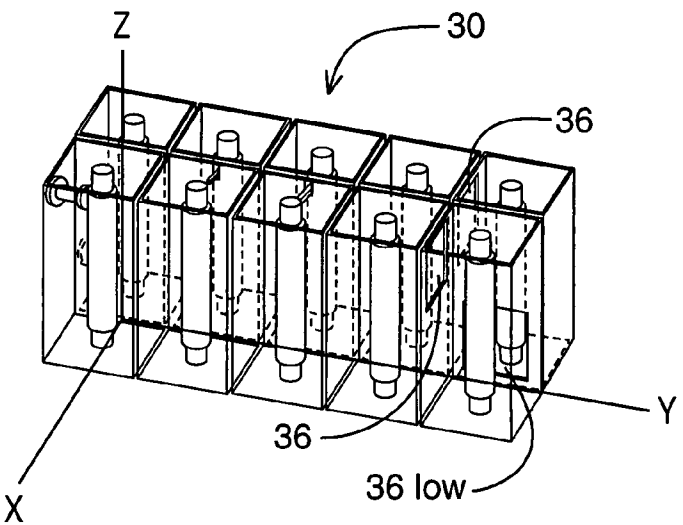
FIG. 5B is a top perspective view of the resonator filter of FIG. 5A.
Figure 5C:
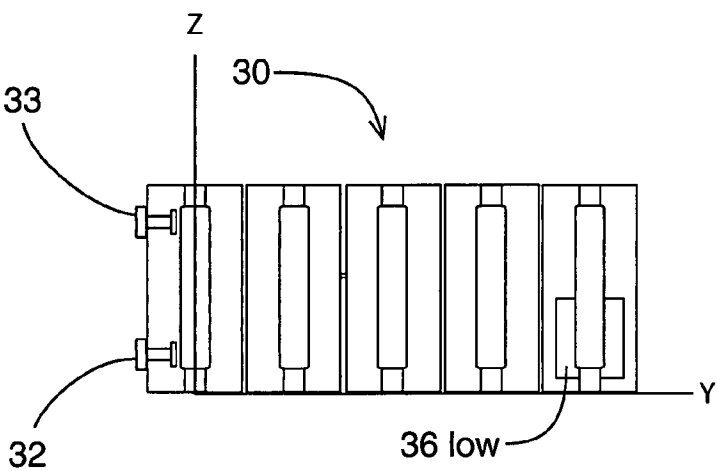
FIG. 5C is a side view of the resonator filter of FIG. 5A in the Y-Z plane.
Figure 5D:
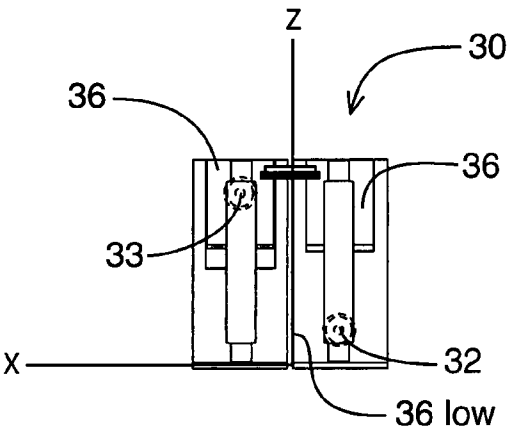
FIG. 5D is a side view of the resonator filter of FIG. 5A in the X-Z plane.

A plurality of rectangular iris openings 36 (as shown in FIGS. 5B, 5C and 5D) are provided within resonator filter 30. However, unlike in the case of resonator filter 20, iris openings 36 are strategically placed within the cavity walls of resonator filter 30 to cancel out stray couplings. Specifically, a number of iris openings 36 are formed at the upper end of the cavity walls within resonator filter 30 and another iris opening 36low (i.e. notated conventionally as the m5,6 iris) is positioned between resonator assemblies r5 and r6 at the lower end of the cavity wall of filter assembly 30 (i.e. below the center line of the cavity wall between resonator assemblies r5 and r6). Finally, it is desirable that input probe 32 is also positioned below the horizontal center line of cavity wall of resonator assembly r10 within resonator filter 30 (FIG. 5C) to aid in the cancellation of the stray couplings. It should be understood that more than one iris opening 36 can be made in a single cavity wall as required.

It has been determined that an offset-type iris opening configuration has a cancellation effect on stray coupling between non-adjacent resonator assembly pairs. Specifically, by changing the vertical placement of the m5,6 iris opening 36 between resonator assemblies r5 and r6 within resonator filter 30 (i.e. by moving it downwards within the cavity wall), it is possible to compensate for stray coupling between non-adjacent resonator assemblies r5, r7 and r4, r6 without the need to use diagonal probes. A diagonal wire probe that provides electrical coupling between r4 and r6 (or r5 and r7) can be used to provide the same effect but adds complexity to the filter and is therefore undesirable. Accordingly, the benefit of eliminating the diagonal coupling probes is reduced complexity. As the electromagnetic wave passes from resonator assembly r5 into resonator assembly r6 through iris opening 36low, the signal leakage will change sign. This allows for cancellation of stray coupling throughout resonator filter 30. Finally, it should be understood that when the iris openings 36 are described as being positioned either at "upper end" or "lower end" of the cavity wall of resonator filter 30, the iris openings 36 are physically positioned either above or below the "center line" of the cavity wall which is located halfway along the cavity wall.

Figure 6A:
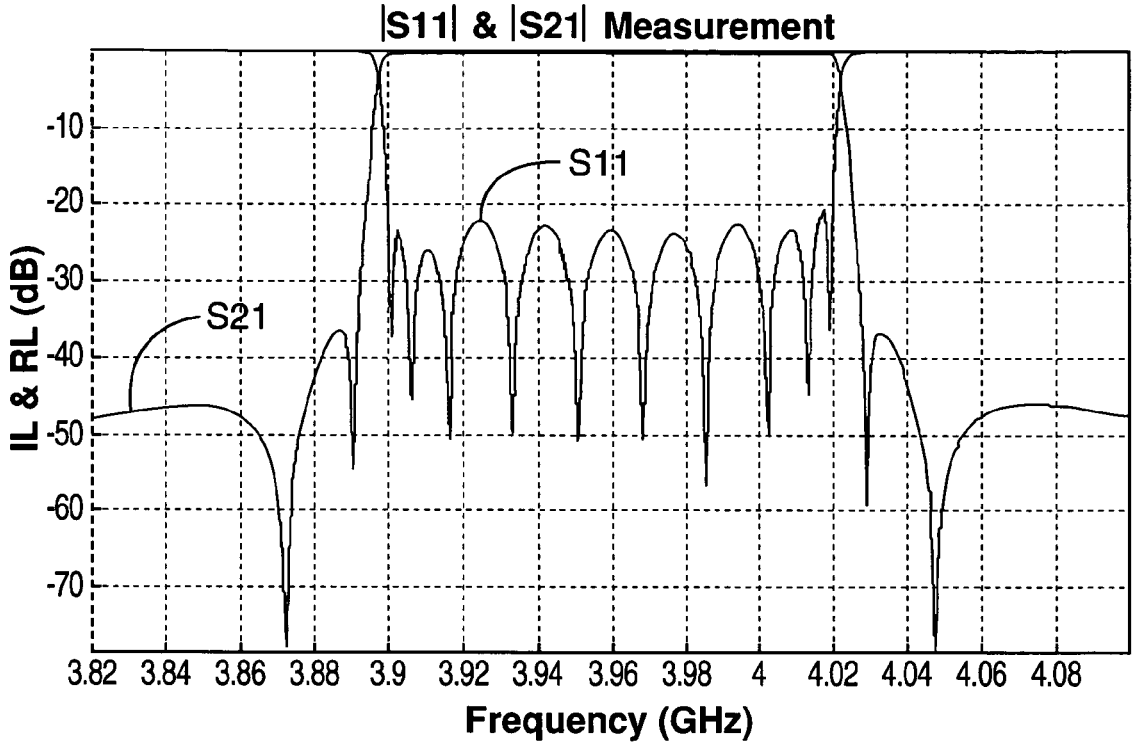
FIGS. 6A and 6B are graphical representations of ideal RF performance under typical performance specifications and actual RF performance of a conventional prior art resonance filter when stray couplings are present.
Figure 6B:
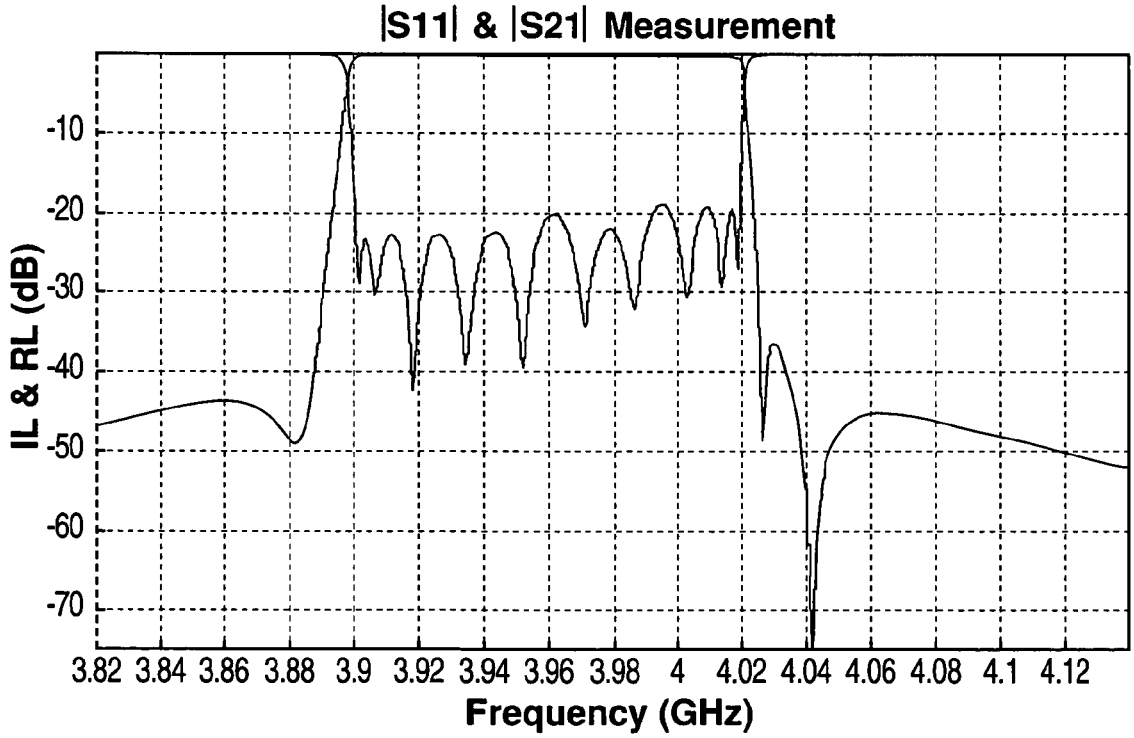

Referring still to FIGS. 5A, 5B, 5C and 5D, the main signal path through resonator filter 30 travels (i.e. couples) from the input probe 32 to the first resonator r1. This coupling is notated as "M0,1 coupling" and is positive. The signal will then travel from resonator r1 to resonator r2 via an iris opening 36 between resonator assembly r1 and r2. This is repeated until the signal reaches the output probe 33 and exits resonator filter 30. Certain couplings are required in order for resonator filter 30 to meet desired performance specifications and are described as Mi,j couplings and are listed in Table 4 below. For example, the coupling between resonators 5 and 6 will be the M5,6 coupling. M1,10, M2,9 and M3,8 cross couplings provide the feedback that is necessary to improve the pass band flatness and stop band attenuation. The typical ideal S11 and S21 response with typical performance specifications is shown in FIG. 6A. When stray couplings are present, conventional filter response does not equal the ideal response and the filter will fail these specifications as shown in FIG. 6B.

TABLE 4

| Sequential Couplings (Mi, j) | |
|---|---|
| Mi, j | Value |
| M0, 1 | 1.0808 |
| M1, 2 | 0.8567 |
| M2, 3 | 0.59495 |
| M3, 4 | 0.54105 |

TABLE 4-continued

| Sequential Couplings (Mi, j) | |
|---|---|
| Mi, j | Value |
| M4, 5 | 0.52572 |
| M5, 6 | 0.5980 |
| M6, 7 | 0.52572 |
| M7, 8 | 0.54105 |
| M8, 9 | 0.59495 |
| M9, 10 | 0.8567 |
| M10, 11 | 1.0808 |
| M1, 10 | 0.016 |
| M2, 9 | −0.007 |
| M3, 8 | −0.080 |

Stray couplings are present to some extent in all filters and generally manifest themselves as a degradation of the S21 response. FIG. 4A shows that the S21 response of resonator filter 20 is inadequate below the center frequency indicating that the stray couplings are predominantly positive. If the response is to be optimum, then an equal but opposite amount of stray coupling must be introduced to cancel the stray couplings that are present. The stray couplings that are present in this filter are described as the Mi,i+2 coupling and are listed in Table 5 below. In order to cancel the stray couplings, there are several differences between resonator filter 20 and resonator filter 30 of the present invention. First, by moving the m5,6 iris opening 36 below the center line of the cavity wall (i.e. iris opening 36low between resonators assemblies r5 and r6 in FIG. 5D), the value of M4,6 couplings and M5,7 couplings is changed from 0.020 to −0.020. Second, by moving input probe 32 to the bottom the sign of the M0,2 coupling is changed from negative to positive. Also, moving the m1,2 iris opening 36 (i.e. 36low between resonator assemblies r1 and r2 in FIG. 5B) below the center line of the cavity wall changes the sign of the M0,2 coupling and the M1,3 coupling from positive to negative. These changes result in a net total stray coupling of zero and allow the filter response to be symmetrical so it can meet the performance specifications discussed above.

TABLE 5

| Stray couplings (Mi, i + 2) | | |
|---|---|---|
| Mi, i + 2 | Uncorrected value | Corrected value |
| M0, 2 | −0.020 | −0.020 |
| M1, 3 | 0.020 | −0.020 |
| M2, 4 | 0.020 | 0.020 |
| M3, 5 | 0.020 | 0.020 |
| M4, 6 | 0.020 | −0.020 |
| M5, 7 | 0.020 | −0.020 |
| M6, 8 | 0.020 | 0.020 |
| M7, 9 | 0.020 | 0.020 |
| M8, 10 | 0.020 | 0.020 |
| M9, 11 | −0.020 | −0.020 |
| Total | 0.120 | 0 |

Figure 7A:
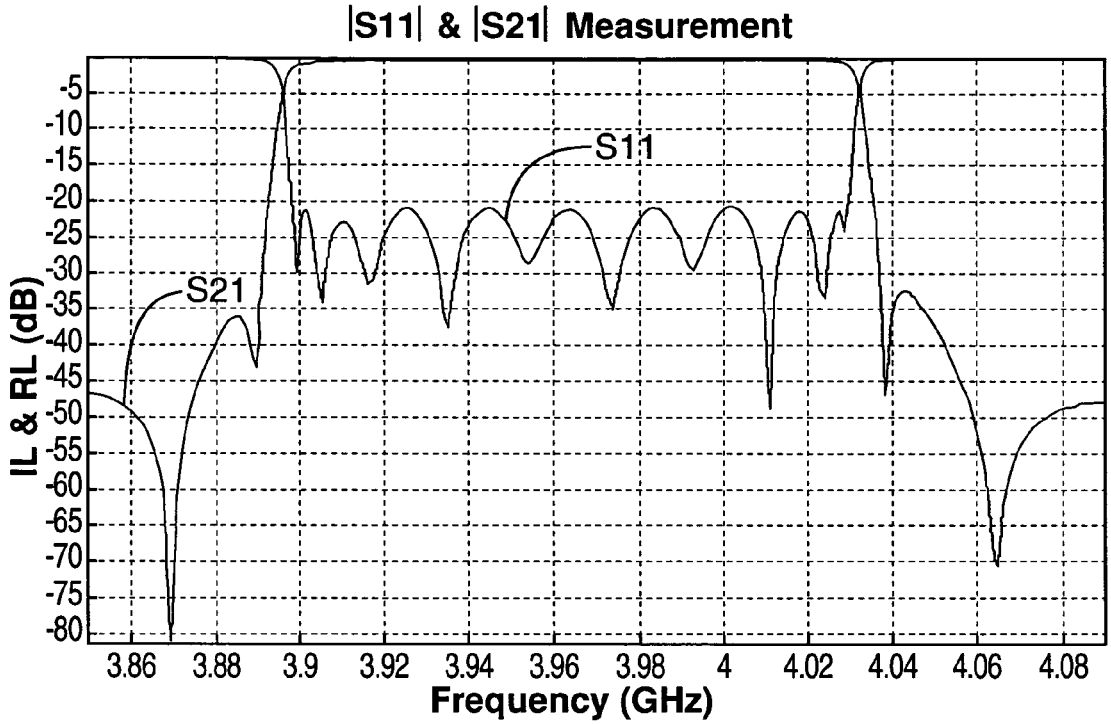
FIGS. 7A and 7B are graphical representations of the RF performance of the resonator filter of FIG. 5A.
Figure 7B:
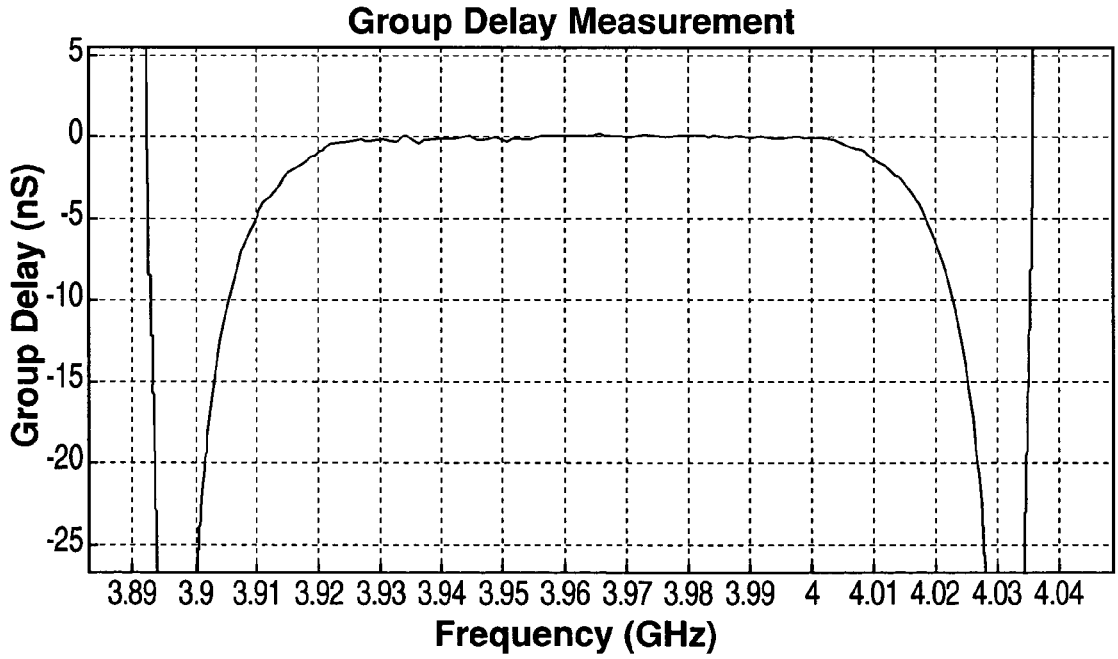

FIGS. 7A and 7B are graphs that illustrate the RF performance of resonator filter 30 at room temperature having a vertically offset iris opening 36low. As shown, by moving the m5,6 iris opening 36 from an upper position to a lower position (i.e. from above the horizontal center line to below the horizontal center line) within the cavity wall of resonator filter 30, the stray coupling that was originally present between the cavities of non-adjacent resonator pairs (i.e.

resonator assemblies r5, r7 or r4, r6) illustrated in FIGS. 4A and 4B, has been removed. That is, the stray coupling present within resonator filter 20 can be cancelled out through the replacement of iris opening 36high with iris opening 36low, while another iris opening 36 remains in the usual above center-line position in the resonator filter. As shown, in FIG. 7A, the nearly symmetrical insertion loss (i.e. S11 and S21) characteristic (FIG. 7A) and the nearly flat group delay characteristic (FIG. 7B) indicate that resonator filter 30 meets relatively stringent filter performance specifications. Most notably, as shown in FIG. 7B, the group delay is significantly flatter than that associated with resonator filter 20 (FIG. 4B).

Prior Art Comparisons

Tables 6 and 7 provide a mass-based comparison between a conventional $TE_{01\delta}$ 10 pole filter and resonator filter 30 at 4 GHz. Masses are all provided in grams. Specifically, the mass comparison measures the mass of filter components that are required to make a flight representative filter for both the conventional $TE_{01\delta}$ 10 pole filter and the resonator filter 30.

TABLE 6

$TE_{01\delta}$ 10 pole Filter Mass Listing

| | Mass(g) | Qty | subtotal |
|---|---|---|---|
| Filter Body(top) | 94.1 | 1 | 94.1 |
| Lid | 21.8 | 1 | 21.8 |
| Resonator | 3.89 | 10 | 38.9 |
| Support | 1.7 | 10 | 17 |
| Pedestal | 0.93 | 10 | 9.3 |
| I/O'Probe | 2.8 | 2 | 5.6 |
| M2, 9 Probe | 0.4 | 1 | 0.4 |
| M3, 8 Probe | 0.8 | 1 | 0.8 |
| M5, 7 Probe | 0.8 | 1 | 0.8 |
| 2–56 screws | 0.115 | 36 | 4.14 |
| 4–40 screws | 0.18 | 3 | 0.54 |
| 4–40 disc screws | 0.7 | 10 | 7 |
| 4–40 nuts | 0.16 | 10 | 1.6 |
| 6–32 screws | 0.7 | 10 | 7 |
| 6–32 nuts | 0.116 | 10 | 1.16 |
| Pedestal nut | 0.9 | 10 | 9 |
| Strapping | | | 5 |
| Total | | | 224.14 grams |

TABLE 7

10 pole Resonator Filter 30 Mass Listing

| | Mass(g) | Qty | Subtotal |
|---|---|---|---|
| Filter Body(top) | 75.28 | 1 | 75.28 |
| Lid | 17.44 | 1 | 17.44 |
| Resonator | 4.17 | 10 | 41.7 |
| Support | 0.14 | 10 | 1.4 |
| I/O'Probe | 2.2 | 2 | 4.4 |
| M2, 9 Probe | 0.2 | 1 | 0.2 |
| M3, 8 Probe | 0.4 | 1 | 0.4 |
| 2–56 screws | 0.115 | 36 | 4.14 |
| 0–80 screws | 0.05 | 8 | 0.4 |
| 2–56 screws | 0.37 | 20 | 7.4 |
| 2–56 nuts | 0.1 | 20 | 2 |
| Strapping | | | 5 |
| Total | | | 159.76 grams |

Figure 8A:
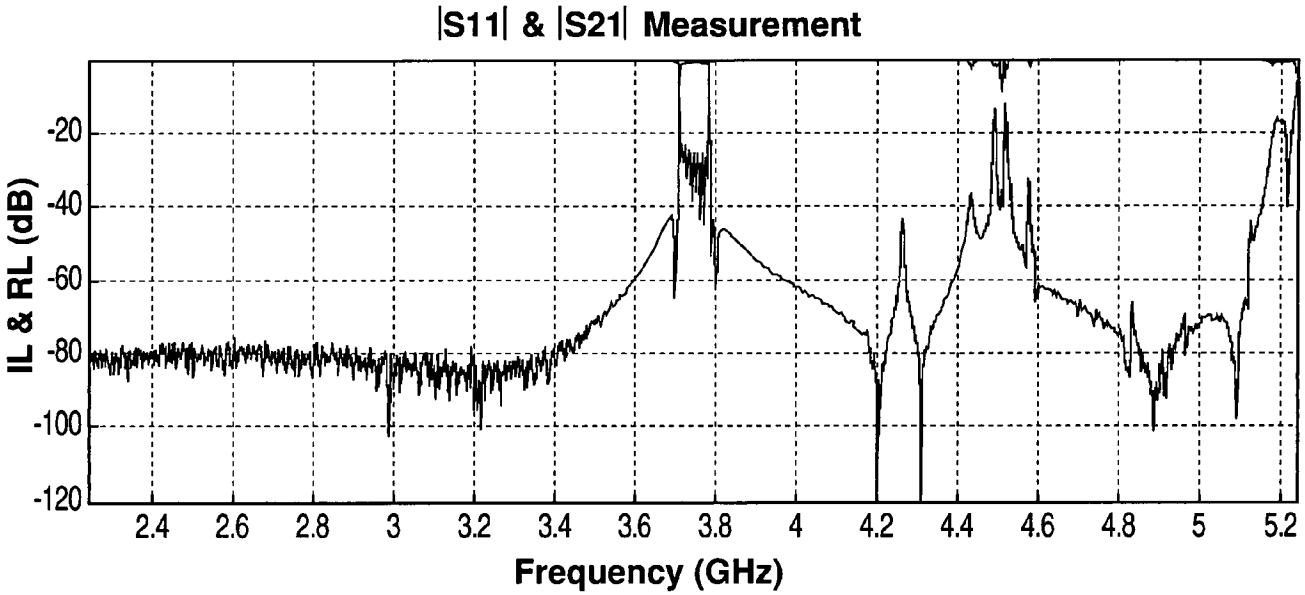
FIG. 8A is a graphical representation of the wideband response for a conventional 10 pole $TE_{01\delta}$ mode (puck) resonator filter.
Figure 8B:
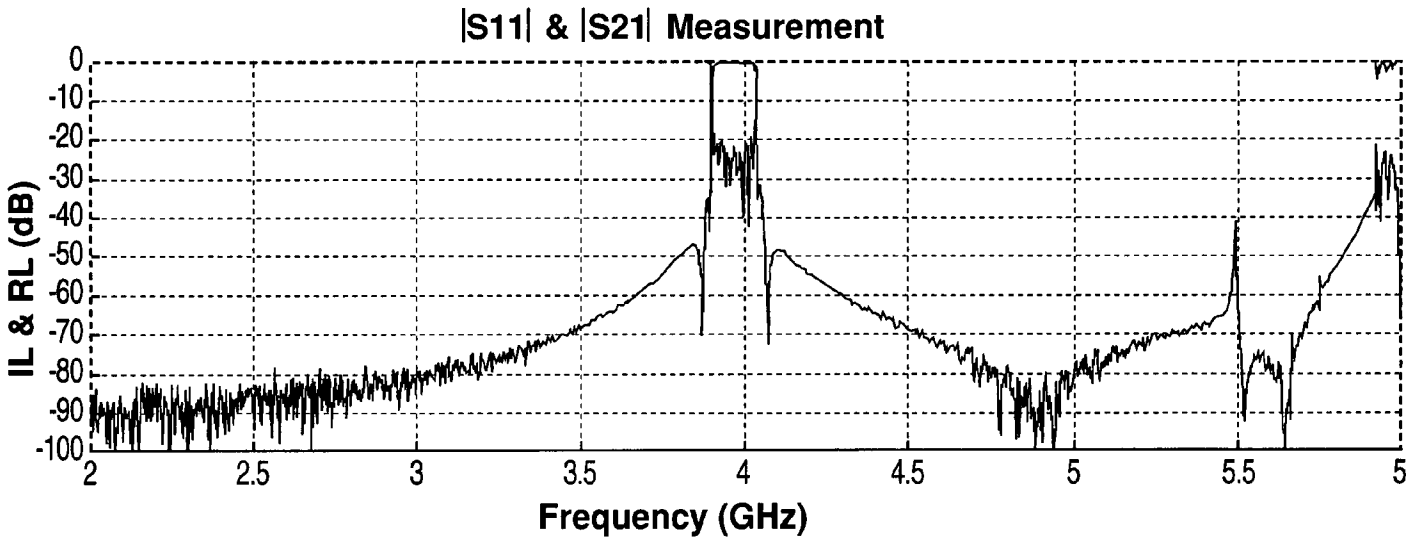
FIG. 8B is a graphical representation of the wideband response for the resonator filter of FIG. 5A.

Finally, a typical wideband response for a prior art filter using $TE_{01\delta}$ mode (puck) resonators is shown in FIG. 8A. As shown, the filter center frequency and bandwidth are 3,745 and 60 MHz, respectively. Since the spurious modes all fall outside of the 3,400 to 4,200 MHz communication band, this $TE_{01\delta}$ mode resonator filter is usable. As can be seen, the nearest spurious is approximately 500 MHz above the center frequency of the filter. Typically that 500 MHz spurious free window will remain constant on this type of filter for a given filter bandwidth. Therefore a filter with a center frequency between 3,400 and 3,700 will have a spurious below 4,200 MHz and will need additional pre-filtering to eliminate the spurious. Such pre-filtering will add cost and complexity to the overall assembly. In contrast, FIG. 8B illustrates the wideband response for resonator filter 30. As shown, resonator filter 30 provides a clean response over a wider bandwidth (1,500 MHz) and will therefore not need any additional pre-filtering for use as a filter with a center frequency between 3,400 and 3,700 MHz.

As will be apparent to those skilled in the art, various modifications and adaptations of the structure described above are possible without departing from the present invention, the scope of which is defined in the appended claims.

The invention claimed is:

1. A resonator assembly for operation within an electrical field at a desired frequency, said resonator assembly comprising:

(a) a resonator cavity having a top surface and a bottom surface;

(b) an elongated dielectric resonator having a length to diameter ratio, said elongated dielectric resonator being positioned within said resonator cavity;

(c) a first insulative support coupled between one ends of the dielectric resonator and one of the top and bottom surfaces of the resonator cavity;

(d) said length to diameter ratio of the elongated dielectric resonator being selected to be in the range of about 4.5 to 6.0 so that when the electric field is applied to the resonator assembly, the half wave variation of the electric field resonates at the desired frequency.

2. The resonator assembly of claim 1, wherein the dielectric resonator and the first insulative support are cylindrical.

3. The resonator assembly of claim 2, further comprising a second support, wherein said second support is coupled between the other end of the dielectric resonator and the other of the top and bottom surfaces of the resonator cavity and wherein the first and second insulative supports each have a diameter smaller than the diameter of the dielectric resonator.

4. A resonator filter for filtering an electromagnetic wave, said resonator filter comprising:

(a) a plurality of the resonator assemblies of claim 1 coupled to each other, adjacent pairs of said resonator cavities being separated from each other by a common cavity wall such that there are a plurality of common cavity walls between adjacent resonator cavities and such that each cavity wall has top and bottom edges;

(b) a first iris opening formed within a common cavity wall; and (c) a second iris opening formed within a common cavity wall, said second iris opening having a position that is vertically offset from the position of the first iris opening.

5. The resonator filter of claim 4, wherein the resonator filter includes an input probe positioned on an input cavity wall for receiving the electromagnetic wave and an output probe positioned on an output cavity wall for providing the filtered electromagnetic wave, wherein said input probe is vertically offset from said output probe.

6. The resonator filter of claim 4, wherein the first iris opening is formed in the same common cavity wall as the second iris opening.

7. The resonator filter of claim 4, wherein the first iris opening is formed in a different common cavity wall than the second iris opening.

8. The resonator filter of claim 4, wherein the second iris opening is positioned at least one common cavity wall away from said first iris opening.

9. The resonator filter of claim 4, wherein all of the common cavity walls are of substantially the same dimension and share a common center line which is located halfway between the top and bottom edges of the cavity walls.

10. The resonator filter of claim 9, wherein the first iris opening is positioned above the center line and the second iris opening is positioned below the center line.

11. The resonator filter of claim 9, wherein said input probe is positioned below the center line of the input cavity wall and said output probe is positioned above the center line of the output cavity wall.

* * * * *

UNITED STATES PATENT AND TRADEMARK OFFICE

CERTIFICATE OF CORRECTION

PATENT NO. : 7,075,392 B2
APPLICATION NO. : 10/678109
DATED : July 11, 2006
INVENTOR(S) : David John Smith et al.

It is certified that error appears in the above-identified patent and that said Letters Patent is hereby corrected as shown below:

Column 12, line 31, claim 1, the phrase "one ends of" has been changed to -- one end of --, so that the line reads -- (c) a first insulative support coupled between one end of --.

Signed and Sealed this

Tenth Day of November, 2009

David J. Kappos

David J. Kappos
*Director of the United States Patent and Trademark Office*